United States Patent [19]

Beerli

[11] Patent Number: 4,722,144

[45] Date of Patent: Feb. 2, 1988

[54] SKI BOOT

[76] Inventor: Louis Beerli, Blumenweg 3, 6390 Engelberg, Switzerland

[21] Appl. No.: 884,428

[22] Filed: Jul. 11, 1986

[30] Foreign Application Priority Data

Jul. 12, 1985 [AT] Austria ..... 2070/85

[51] Int. Cl.[4] ..... A43B 5/04; A43B 13/14

[52] U.S. Cl. ..... 36/117; 36/25 R

[58] Field of Search ..... 36/117–121, 36/132, 25 R; 12/120.5

[56] References Cited

U.S. PATENT DOCUMENTS

| | | | |
|---|---|---|---|
| 4,041,619 | 8/1977 | Sapper | 36/25 R |
| 4,505,057 | 3/1985 | Kiester . | |

FOREIGN PATENT DOCUMENTS

| | | | |
|---|---|---|---|
| 189541 | 4/1957 | Austria . | |
| 345126 | 8/1978 | Austria . | |
| 346207 | 10/1978 | Austria . | |
| 363815 | 9/1981 | Austria . | |
| 0049019 | 4/1982 | European Pat. Off. | 36/25 R |
| 461028 | 6/1928 | Fed. Rep. of Germany . | |
| 836306 | 4/1952 | Fed. Rep. of Germany . | |
| 1685739 | 9/1971 | Fed. Rep. of Germany . | |
| 2835779 | 3/1979 | Fed. Rep. of Germany | 36/132 |
| 2917542 | 11/1980 | Fed. Rep. of Germany | 36/117 |
| 3115702 | 4/1982 | Fed. Rep. of Germany . | |
| 1128009 | 8/1956 | France . | |
| 2376636 | 8/1978 | France . | |
| 609541 | 3/1979 | Switzerland . | |

*Primary Examiner*—James Kee Chi

*Attorney, Agent, or Firm*—Shenier & O'Connor

[57] ABSTRACT

The ski boot shall allow an as convenient as possible walking on the ground surface and also a stable standing on the ground surface. To this end the heel and the sole of the boot are provided individually with a roll off area. When the ski boot rolls off on the ground surface, the two roll off areas combine. To this end the center of the radius on the roll off area of the heel is located in the area of the ankle. The center of the radius of the roll off area located at the sole of the shoe lies in the center of the knee joint. When walking with this boot, a rising and downwards movement of the ankle is avoided. Accordingly, the ski boot comprises a stable standing area which stabilizes the body when it stands. During the walking, the position of the center of gravity of the weight of the body is altered automatically such that the standing area cannot form a standing plane. Conclusively, the rolling off movement during walking is a smooth movement.

3 Claims, 5 Drawing Figures

SKI BOOT

BACKGROUND OF THE INVENTION

1. Field of the Invention

The present invention relates generally to ski boots and specifically to an improved ski boot including an inflexible rigid sole and a shaft arranged immovably relative to the sole and including further a circular roll off area located at said sole to facilitate the walking with the ski boot and defining the heel thereof.

Ski boots are presently customarily made of a plastic material. Such boots comprise an inflexible rigid shaft which is immovably connected to a rigid and commonly flat planar sole. Because such rigid connection blocks the ankle, it is quite inconvenient to walk with such a boot. In order to improve the stability of the skier on his skis the shaft is usually inclined forwardly relative to the sole by an angle generally known as "forward lean angle". Such a boot is still worse regarding a walking therein.

2. Description of the Prior Art

In order to facilitate the walking with rigid ski boots it has already been proposed to form the shoe sole cambered in the longitudinal direction thereof. Accordingly when the wearer of such ski boots is walking, the shoe can roll off on the cambered sole and, therefore, the tibia can easily be bent relative to the knee. This indeeds allows an improved walking with the shoe; however, if the wearer stands still, the shoe will rock on its standing surface.

It has been suggested further to shape a portion of the cambered sole as a flat planar standing area. Such a boot incorporates in the center section of its sole a standing area which at the front and at the rear passes into a respective roll off area. Such a shoe is disclosed in the CH-PS No. 609 541. It is possible to walk and to stand safely with such shoe, but the standing area interrupts and disturbs a smooth rolling off of the sole at its standing area during the walking motion. It also has been found that when wearing this boot vertical movements, specifically of the ankle, are carried out during the rolling off movement of the sole such that at each step the body of the wearer rises and descends. These continued rocking motions of the center of gravity of the body of the wearer are quite tiresome when walking with these boots.

The U.S. Pat. No. 4 505 057 discloses a ski boot having a circular roll off area acting as heel of the boot which indeed does facilitate the walking; however, the vertical rocking movements of the ankle of the wearer are not obviated therewith.

It is generally known that when walking barefooted the ankle is not subjected to horizontal rocking movements and the smooth swinging movement of the tibia will not be disturbed by the standing area of the foot.

SUMMARY OF THE INVENTION

An object of the present invention is to provide an improved ski boot of the kind mentioned above which does not generate mentioned drawbacks during a walking and the standing of its wearer.

A further object is to provide an improved ski boot including an inflexible or rigid sole and a shaft arranged immovably relative to the sole and including further a circular roll off area located at the sole to facilitate the walking with the ski boot and defining the heel thereof, in which the center of the radius of the circular roll off area is located at the area of the ankle.

BRIEF DESCRIPTION OF THE DRAWINGS

The invention will be better understood and objects other than those set forth above will become apparent when consideration is given to the following detailed description thereof. Such description makes a reference to the annexed drawings, wherein.

DESCRIPTION OF THE PREFERRED EMBODIMENT

Figure 1:
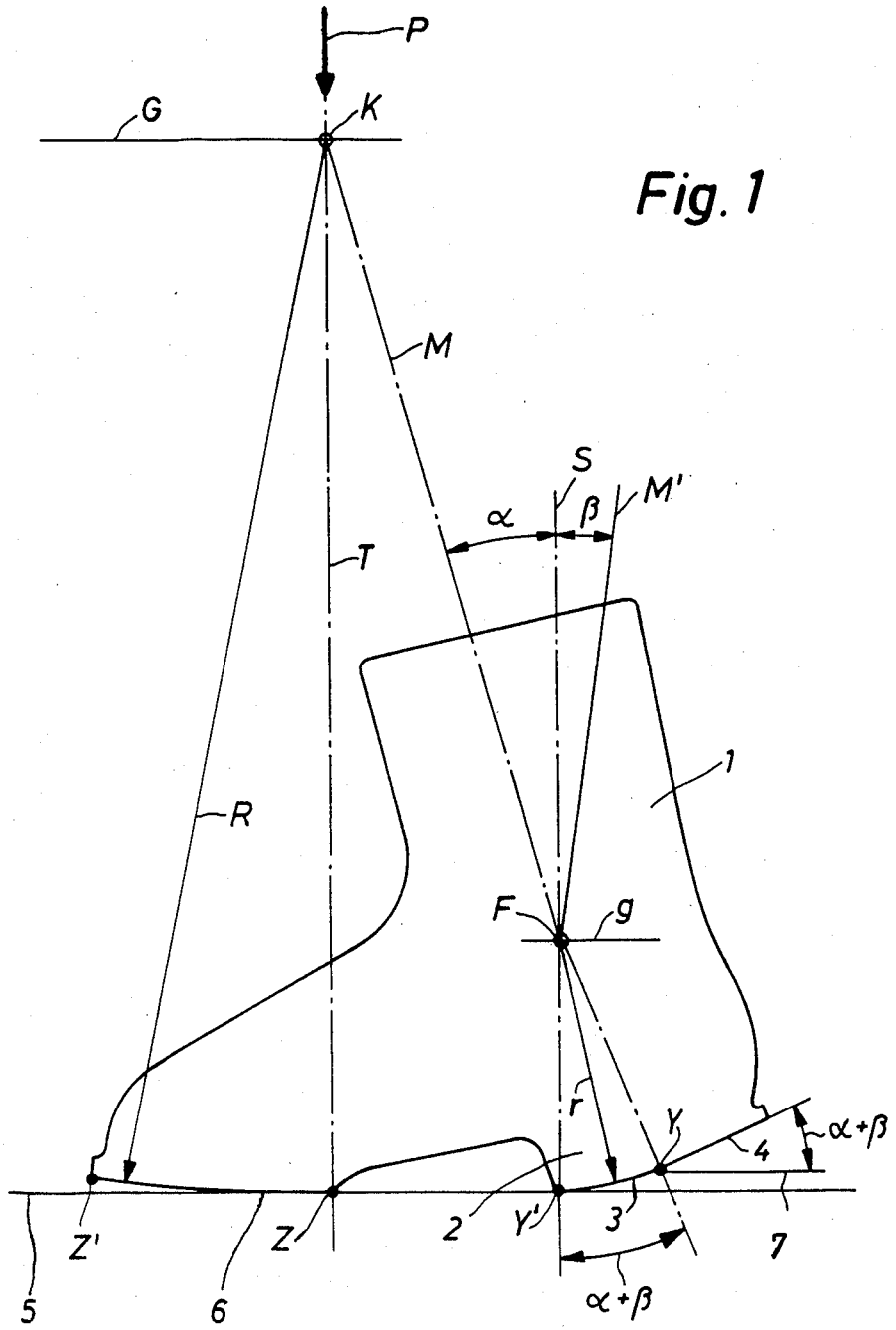
FIG. 1 illustrates schematically a side view of a ski boot in a walking position which at the same time is the standing position thereof.
Figure 3:
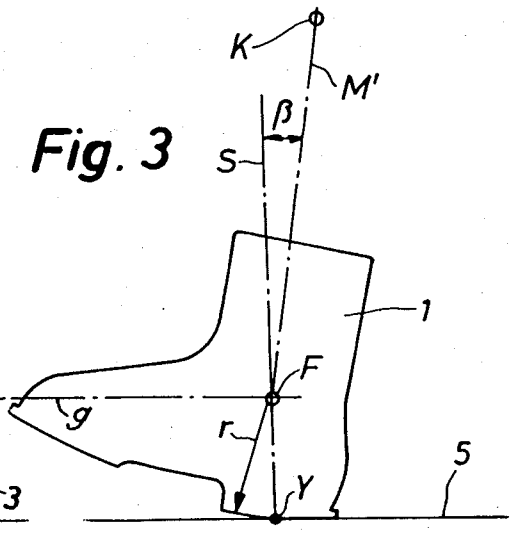
FIGS. 3, 4 and 5 illustrate schematically side views of the boot of FIG. 1 in three successive walking positions.

The drawings illustrate a ski boot with which the above discussed disturbing height differences of the center of gravity do not appear any longer during the walking motion. The boot includes a heel 2 having a roll off area 3 which extends between two points Y and Y'. The center of the radius r of the area 3 is located in the ankle F. The center axis of the shaft 1 illustrated in the standing position according to FIG. 1 is identified by M. If the shoe is in the rearwardly tilted position as illustrated in FIG. 3, a flat planar area 4 of the heel 2 abuts completely the ground surface 5 and the center axis is located in the position M'. Relative to an axis S extending perpendicularly to the ground surface 5, the shaft 1 of FIG. 1 is tilted forwardly by a forward leaning angle $\alpha$ such that the surface 6 of the sole lies flatly on the ground surface 5. According to FIG. 3 the shaft can be swung from mentioned position rearwards by the angle $\alpha+\beta$. The points of contact of the roll off area 3 with the ground surface 5 belonging to such tilting movement are the points Y and Y'. The continuation of this roll off area 3 after point Y extends until the rear end of the shoe along a tangent to the roll off area 3 which forms the flat planar area 4. It extends relative to the line 7 extending parallel to the ground surface 5 at an angle $\alpha+\beta$.

Figure 4:
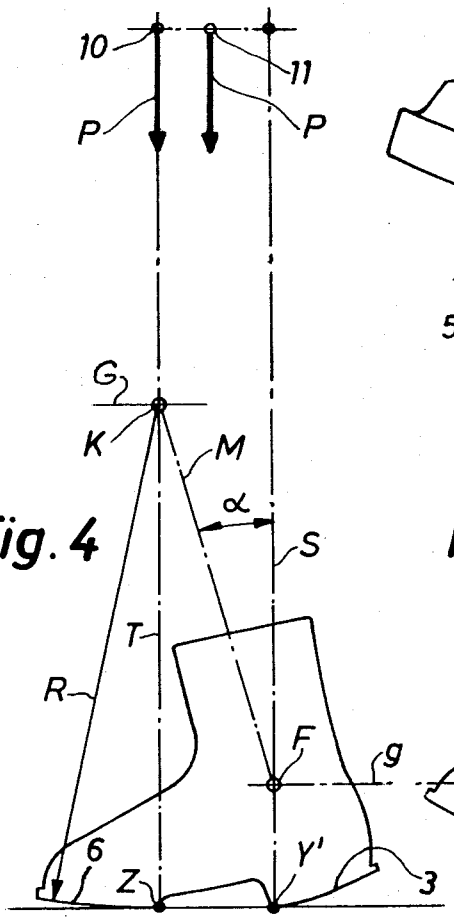

If upon a walking the shaft 1 moves from the position according to FIG. 3 into the position according to FIG. 4 and accordingly the center axis is moved from the position M' to the position M, the roll off area 3 rolls from point Y to point Y', and the ankle F moves along the line g extending parallel to the ground surface 5. The center axis M of the shaft 1 is at the same time the center axis of the shinbone which carries the knee joint K and the ankle F. P indicates the direction of the body weight, which acts onto the knee joint K which is loaded accordingly. The perpendicular line T extending through the knee joint K intersects the surface 6 of the sole at the point Z which abuts the ground surface 5 and limits the standing area Y'-Z. The continuation of the surface of the sole after point Z to the tip Z' of the shoe has the shape of a section of a circular line having the radius R, of which the center is located in the knee joint K. Upon a rolling off of the surface Z-Z' of the sole the knee joint K moves along a line G extending parallel to the ground surface 5. A surface of the sole of the boot structured in this manner has already been disclosed in the FR-PS No. 237 66 36.

In the walking position illustrated in FIG. 1 the boot contacts the ground surface 5 at points Y' and Z, i.e.

simultaneously at both roll off areas 3 and 6. If during a walking one of the roll off areas has been completely rolled on the ground surface, the boot contacts already at its other roll off area the ground surface and thus can continue its rolling off movement.

Figure 2:
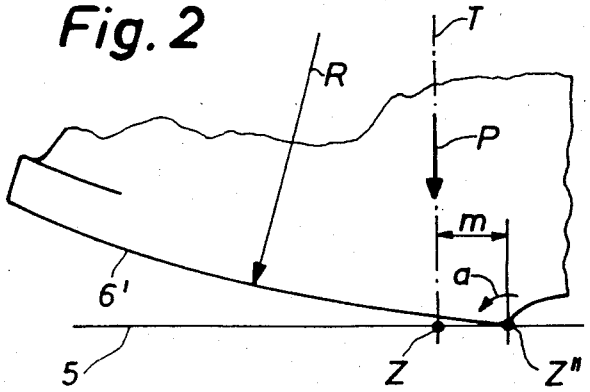
FIG. 2 illustrates schematically an alternative design of the sole surface of the boot illustrated in FIG. 1.

FIG. 2 illustrates on an enlarged scale a further embodiment of the surface of the sole of the boot illustrated in FIG. 1. This surface 6' of the sole extends according to a section of a circular line having the radius R. Its center is located on the parallel line G (FIG. 1), however is offset by a measure m relative to the point Z. At the same time the point Z'' forms the center of rotation of the torque ($P \times m$), which is generated by the pressure P of the body of the wearer onto the knee joint K. The arrow a indicates the sense of rotation of the torque which acts on the boot regarding its swinging motion. This torque acts in any position of the knee joint K as long as it moves along the line K designed in FIG. 1. The measure m can be selected to be that large that the torque generated by this measure is strong enough to swing the boot in direction of the arrow a. Accordingly, when walking the boot can roll off by itself along its complete surface 6' of the sole. Walking, therefore, is quite easy and convenient.

Figure 5:
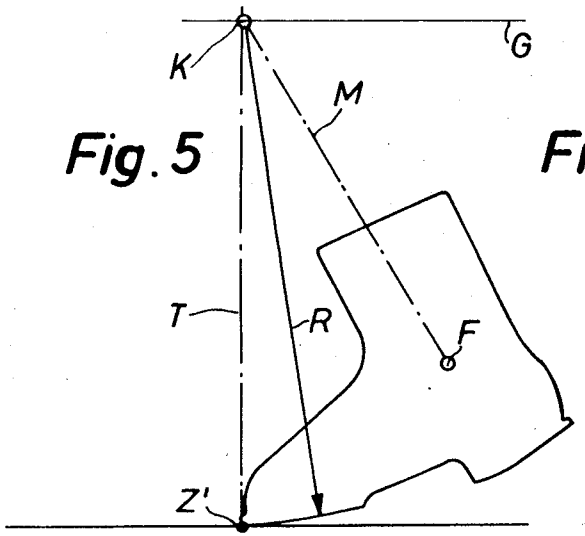

FIGS. 3, 4 and 5 illustrate the boot of FIG. 1 in three successive positions which are encountered during a walking. FIG. 3 illustrates the boot at the beginning of a step when it is initially placed onto the ground surface 5. Shaft 1 is in a rearward position relative to the axis S by an angle $\beta$. During the rolling off of the boot by the angles $\alpha$ und $\beta$ into the position of FIG. 4 the ankle F moves along the line g parallel to the ground surface 5. Simultaneously, the area 3 rolls from point Y to point Y'. During this motion the ankle is not subjected to vertical movements. The continued rolling off of the boot on the ground surface 5 into the position illustrated in FIG. 5 proceeds without any interruption to the forward roll off area Z-Z'. Now the knee joint K moves along the line G extending parallel to the ground surface 5 until the end position according to FIG. 5 is reached, whereafter the boot is lifted off of the ground surface. In FIG. 4 two possible positions of the center of gravity of the body weight P are identified by 10 and by 11. If this center of gravity is located between the two vertical lines S and T, for instance, in the position identified by 11, the body weight P rests on the two points Y' and Z, which now form the stability when the body is standing, i.e. does not move. If the center of gravity of the body is located in the position identified by 10, which is perpendicularly above the knee joint, the body weight P rests during the moving of the knee joint K, either on the roll off area 3 having the point Y' or the roll off area 6 having the point Z. The points or locations, respectively, Y' and Z are not loaded simultaneously and do not act anymore as supports.

During the walking the center of gravity P of the body is located always in the position identified by 10. The forming of a standing area is not possible because always one support is missing. The smooth rolling off of the boot during walking will, therefore, not be interrupted. Because no vertical movements are generated when the boot rolls off with its area Y-Y' on the ground surface 5 and thereafter when it rolls off on the surface of the sole Z-Z' in the knee joint K, the vertical swinging motions of the center of gravity of the body are not larger than those made when walking barefoot.

The dissimilarities of the upper surface of the ski relative to the shape of the surface 6 of the sole of the ski boot and the roll off area 3 can be equalized by supporting pad members mounted rigidly to the ski.

While there are shown and described present preferred embodiments of the invention, it is to be distinctly understood that the invention is not limited thereto, but may be otherwise variously embodied and practiced within the scope of the following claims.

I claim:

1. An improved ski boot including an inflexible rigid sole and a shaft arranged immovably relative to said sole and including further a circular roll off area located at said sole to facilitate the walking with the ski boot and defining the heel thereof, in which the center of the radius of said circular roll off area is located at the area of the ankle.

2. The improvement of claim 1 including a forwardly inclined shaft and further a forward roll off surface arranged as roll off area at the toe section of the boot, comprising a standing area, the rearward end of which being defined by the perpendicular line intersecting the ankle and the forward end of which being defined by a radius having its center located in the knee joint.

3. The improvement of claim 1 including a forwardly inclined shaft and further a forward roll off surface arranged as roll off area at the toe section of the boot, comprising a standing area, the rearward end of which being defined by the perpendicular line intersecting the ankle and the forward end of which being defined by a radius of which the center proceeding from the location of the knee joint is set back along the line extending parallel to the ground surface by a measure such to generate a torque, which measure is the geometrical arm of said torque.

* * * * *